US007246545B1

(12) United States Patent
Lee

(10) Patent No.: US 7,246,545 B1
(45) Date of Patent: Jul. 24, 2007

(54) BI-SECTIONAL WRENCH

(76) Inventor: Yi-Min Lee, No. 148, Chaofu Rd., Situn District, Taichung City, 40757 (TW)

( * ) Notice: Subject to any disclaimer, the term of this patent is extended or adjusted under 35 U.S.C. 154(b) by 0 days.

(21) Appl. No.: 11/409,655

(22) Filed: Apr. 24, 2006

(51) Int. Cl.
*B25B 23/16* (2006.01)
*B25B 13/46* (2006.01)

(52) U.S. Cl. ..... 81/177.9; 81/177.8

(58) Field of Classification Search ..... 81/177.8, 81/177.9, 58

See application file for complete search history.

(56) References Cited

U.S. PATENT DOCUMENTS 2,607,253 A * 8/1952 Gearhart ..... 81/58
5,419,221 A * 5/1995 Cole ..... 81/60
5,941,141 A * 8/1999 Whitley ..... 81/63.1
6,032,555 A * 3/2000 Whitley ..... 81/63.1
6,101,907 A * 8/2000 McGovern et al. ..... 81/177.8
6,216,565 B1 * 4/2001 McCann ..... 81/177.8
6,752,048 B1 * 6/2004 Chiang ..... 81/63.1
6,840,141 B2 * 1/2005 Cole ..... 81/177.8
6,928,904 B2 * 8/2005 Hsien ..... 81/60
6,993,998 B1 * 2/2006 Kao et al. ..... 81/60
2005/0016332 A1 * 1/2005 Hu ..... 81/177.8
2006/0137491 A1 * 6/2006 Chen ..... 81/58

* cited by examiner

*Primary Examiner*—David B. Thomas
(74) *Attorney, Agent, or Firm*—Banger Shia

(57) ABSTRACT

A bi-sectional wrench includes a lever, a handle and a toothed wheel. The lever includes a space defined therein and a plurality of teeth formed on the wall of the space. The handle includes a space defined therein and a plurality of teeth formed on the wall of the space. The toothed wheel is movable in the spaces between a first position and a second position. The teeth of the toothed wheel are engaged with the teeth of the handle and the teeth of the lever so that the handle and the lever are pivoted by a common angular speed in the first position of the toothed wheel. The teeth of the toothed wheel are only engaged with the teeth of the handle or the lever so that the handle and the lever are pivoted by different angular speed in the second position of the toothed wheel.

11 Claims, 7 Drawing Sheets

5–5

8–8

BI-SECTIONAL WRENCH

BACKGROUND OF INVENTION

1. FIELD OF INVENTION

The present invention relates to a wrench and, more particularly, to a bi-sectional wrench.

2. RELATED PRIOR ART

A typical wrench includes a single-pieced design that includes a handle and a head formed at an end of the handle. Such a single-pieced wrench can be used in an open space; however, it cannot conveniently be used in a limited space.

There are some wrenches that include two sections. Examples of such bi-sectional wrenches can be found in Taiwanese Patent Publication Nos. 450185 and 569860 and Taiwanese Patents I241940 and I242483. The bi-sectional wrenches can be switched between modes. In the first mode, the angle between the sections is retained. In the second mode, the angle between the sections can be changed. The bi-sectional wrenches are however normally kept in the first mode. The sections are normally pivoted by a common angular speed. It is however difficult to maneuver the bi-sectional wrenches this way in limited space.

The present invention is therefore intended to obviate or at least alleviate the problems encountered in prior art.

SUMMARY OF INVENTION

It is the primary objective of the present invention to provide a wrench with two sections that can be pivoted by a common angular speed when there is abundant room for maneuvering and by different angular speeds when there is only limited room for maneuvering.

According to the present invention, a bi-sectional wrench includes a lever, a handle and a toothed wheel. The lever includes a space defined therein and a plurality of teeth formed on the wall of the space. The handle includes a space defined therein and a plurality of teeth formed on the wall of the space. The toothed wheel is movable in the spaces between a first position and a second position. The teeth of the toothed wheel are engaged with the teeth of the handle and the teeth of the lever so that the handle and the lever are pivoted by a common angular speed in the first position of the toothed wheel. The teeth of the toothed wheel are only engaged with the teeth of the handle or the lever so that the handle and the lever are pivoted by different angular speed in the second position of the toothed wheel.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
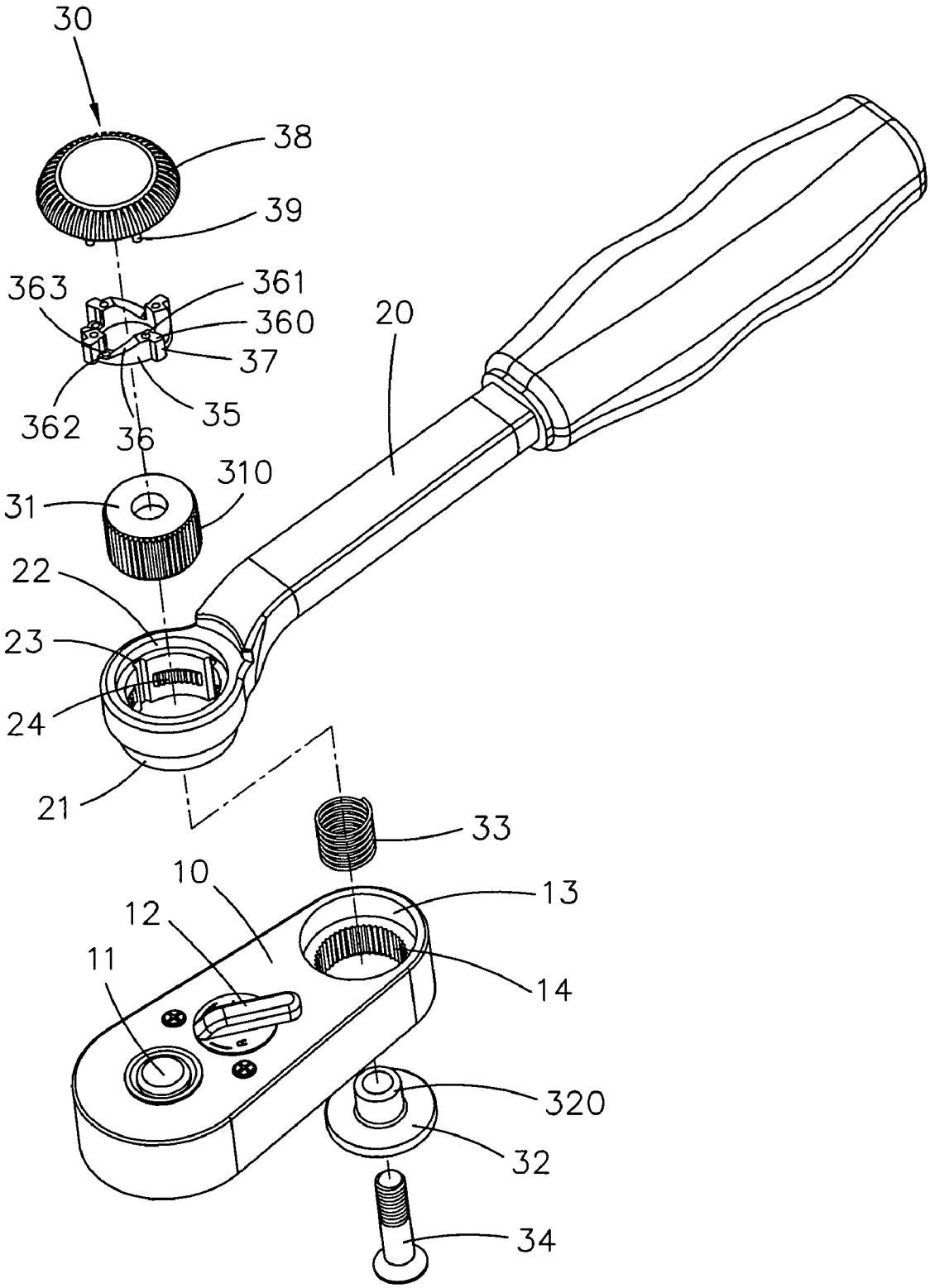
FIG. 1 is an exploded view of a bi-sectional wrench according to the preferred embodiment of the present invention.
Figure 2:
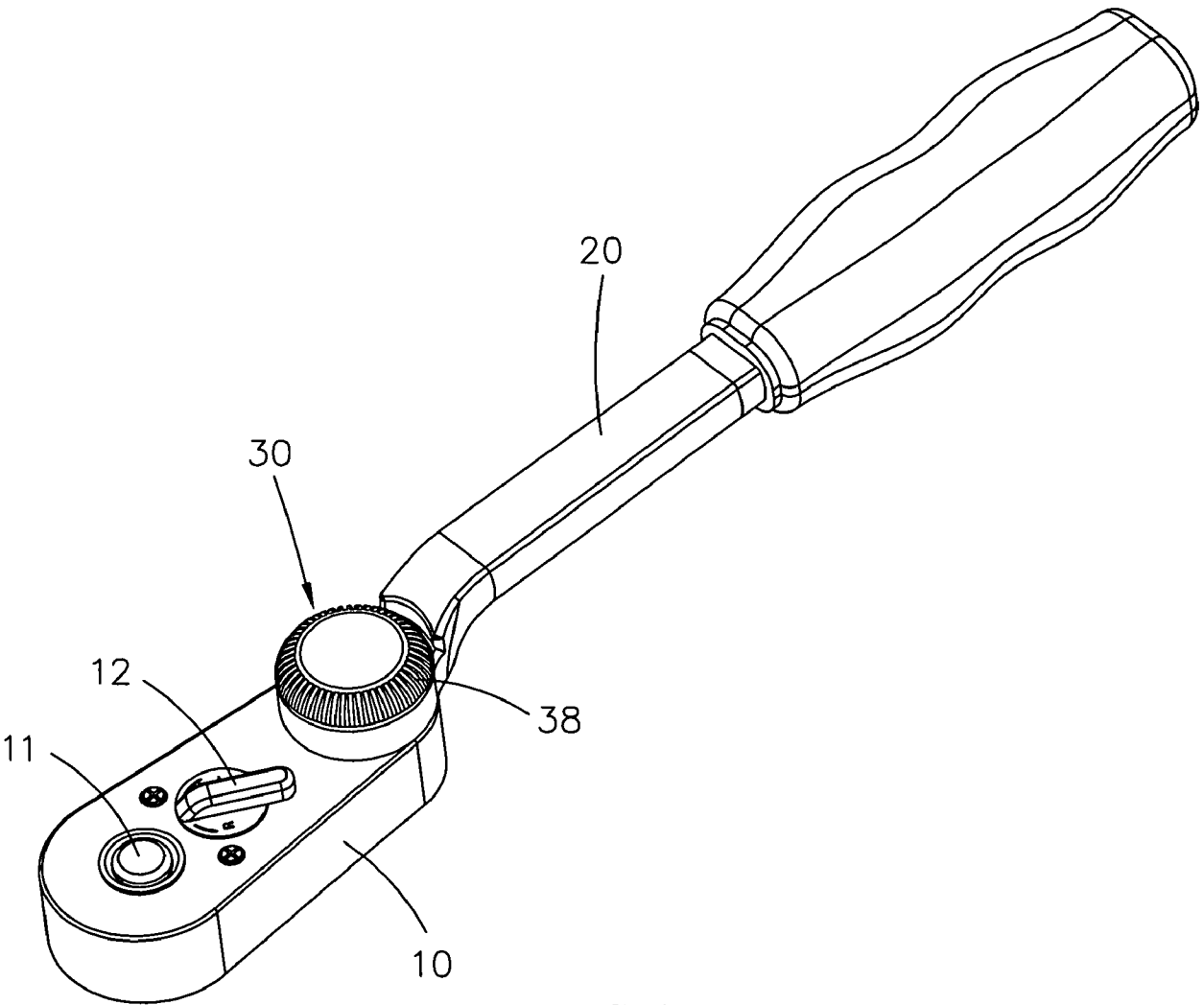
FIG. 2 is a perspective view of the bi-sectional wrench of FIG. 1.
Figure 3:
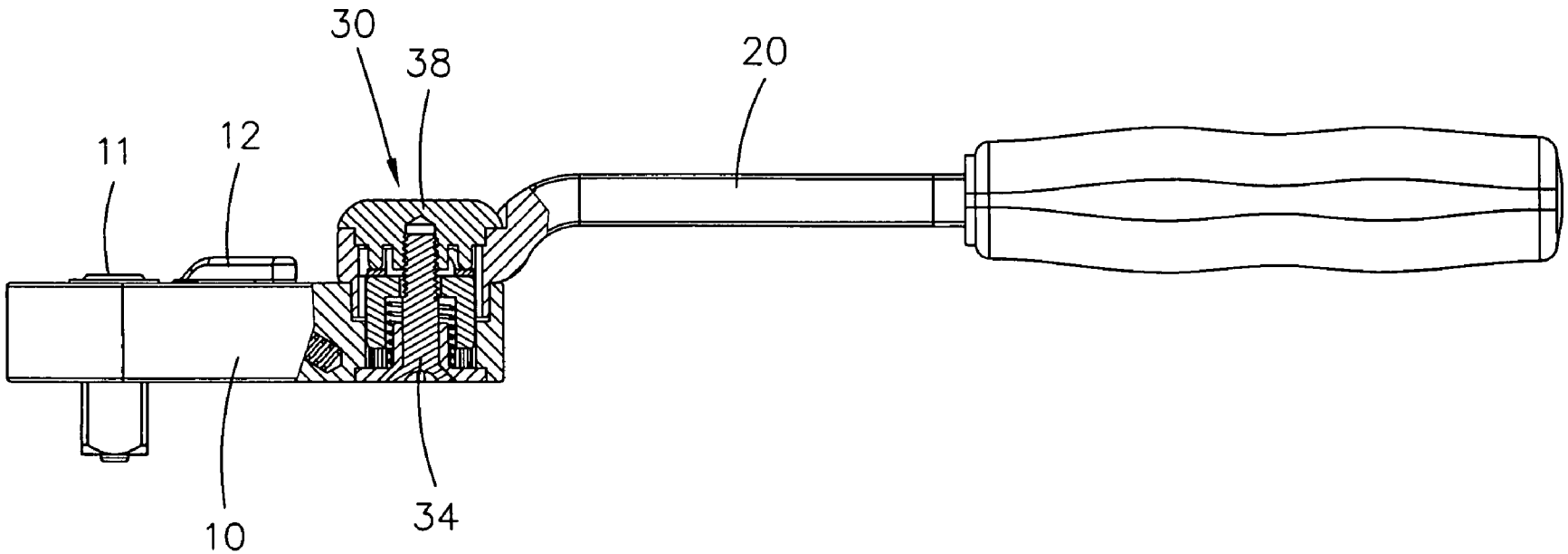
FIG. 3 is a cross-sectional view of the bi-sectional wrench shown in FIG. 2.

Referring to FIGS. 1 through 3, there is shown a bi-sectional wrench in accordance with the preferred embodiment of the present invention. The bi-sectional wrench includes a lever 10, a handle 20 and a connecting device 30 for pivotally connecting the handle 20 to the lever 10.

The lever 10 includes a selective one-way driver 11 provided at a first end, a space 13 defined in a second end opposite to the first end and a switch 12 connected to the selective one-way driver 11.

The selective one-way driver 11 is preferably used together with a socket. The selective one-way driver 11 includes a square insert. The socket defines a square recess in a first end and a hexagonal recess in a second end opposite to the first end. The square insert of the selective one-way driver 11 can be inserted in the square recess of the socket. The selective one-way driver 11 can drive the socket in a selected one of two opposite directions.

The switch 12 can be operated to select from the opposite sections of the selective one-way driver 11. The switch 12 and the selective one-way driver 11 will not be described in detail for being conventional.

A plurality of teeth 14 is formed on the wall of the space 13.

The handle 20 includes an insert 21 transversely extended from a first end and a grip installed at a second end opposite to the first end. The insert 21 defines a space 22. Four groups of teeth 24 are formed on the wall of the space 22. Four grooves 23 are defined in the wall of the space 22 so that the groups of teeth 24 are separated from each other by the grooves 23.

The connecting device 30 includes a toothed wheel 31, an elastic element 33, a pusher 35, a switch 38, a cover 32 and a fastener 34.

The toothed wheel 31 by nature includes a plurality of teeth 310 formed on the periphery. The toothed wheel 31 is positioned in the space 22. The toothed wheel 31 can be moved between a first position and a second position. In the first position, the teeth 310 of the toothed wheel 31 are engaged with the teeth 24 of the handle 20 and the teeth 14 of the lever 10 so as to retain the angle between the lever 10 and the handle 20. In the second position, the teeth 310 of the toothed wheel 31 are engaged with only the teeth 14 of the lever 10.

Also positioned in the space 22 is the elastic element 33 for biasing the toothed wheel 31 to the first position. The elastic element 33 may be in the form of a spring.

The pusher 35 includes four slides 37 formed on the periphery and four slopes 36 formed on an upper side. Each of the slopes 36 includes an upper end 360 defining an upper hole 361 and a lower end 362 defining a lower hole 363. The pusher 35 is positioned in the space 22. The slides 37 are positioned in the grooves 23 so that the pusher 35 is movable but not rotational in the space 22.

The switch 38 includes four rods 39 formed on a lower side. The switch 38 is rotationally installed on the pusher 35. The rods 39 are movably installed on the slopes 36.

The cover 32 includes a tube 320 formed on an upper side. The cover 32 is positioned beneath the insert 21. The tube 320 is inserted in the elastic element 33.

The fastener 34 is driven into a screw hole defined in a lower side of the switch 38 through the cover 32, the elastic element 33, toothed wheel 31 and pusher 35. The fastener 34 may be in the form of a threaded bolt.

Figure 5:
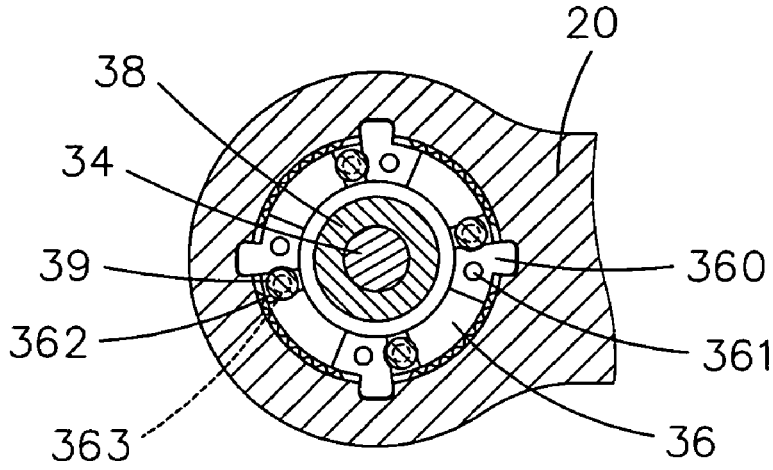
FIG. 5 is a cross-sectional view of the bi-sectional wrench taken along a line 5—5 in FIG. 4.
Figure 4:
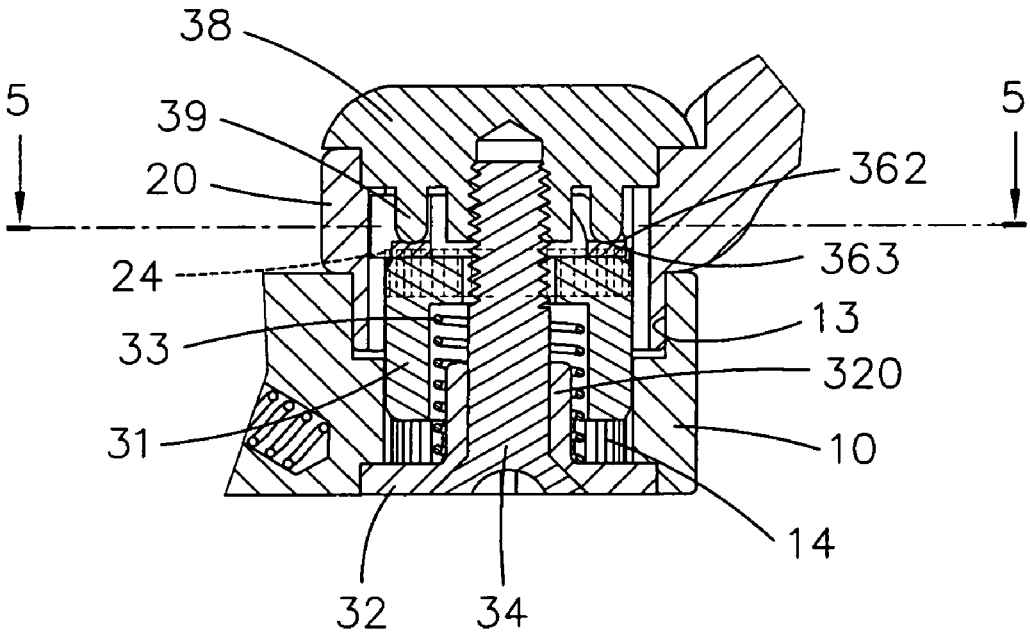
FIG. 4 is an enlarged partial view of the bi-sectional wrench shown in FIG. 3.

Referring to FIGS. 4 and 5, the switch 38 is rotated to a first position where the tips of the rods 39 are located in the lower holes 363. The toothed wheel 31 is pushed to the first position by the elastic element 33. The teeth 310 of the toothed wheel 31 are engaged with the teeth 14 of the lever 10 and the teeth 24 of the handle 20. The angle between the handle 20 and the lever 10 is retained.

Figure 6:
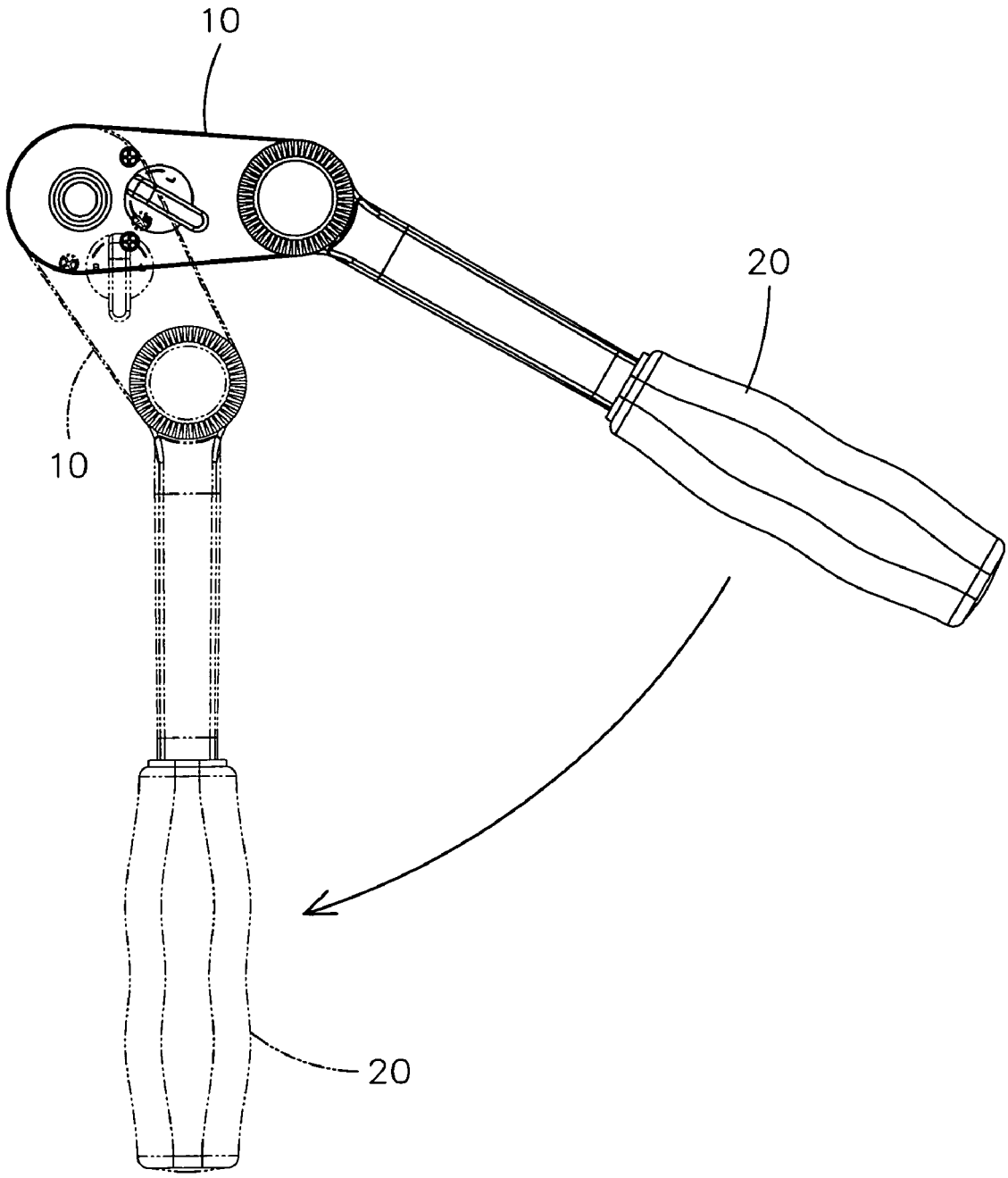
FIG. 6 is a top view of the bi-sectional wrench of FIG. 2, showing the bi-sectional wrench in various positions.

Referring to FIG. 6, the bi-sectional wrench is operated in a first manner in which the lever 10 and the handle 20 are rotated by a common angular speed. The first manner is preferred when a large torque is required and there is abundant room for maneuvering.

Figure 8:
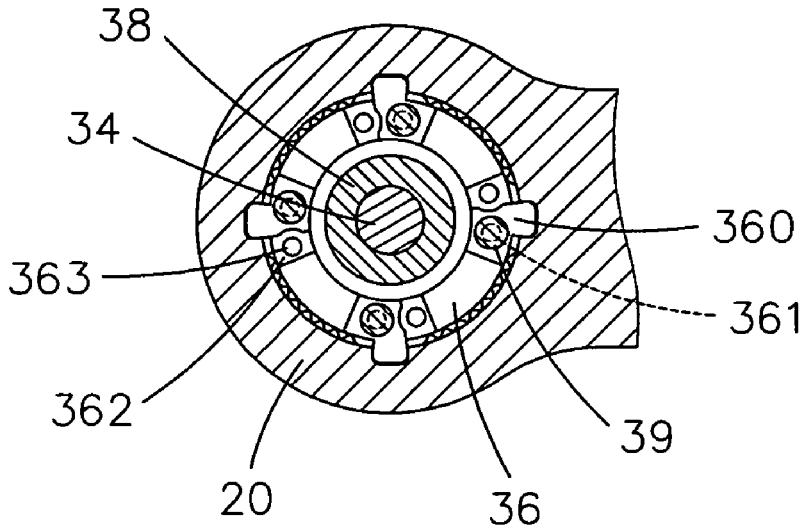
FIG. 8 is a cross-sectional view of the bi-sectional wrench taken along a line 8—8 in FIG. 7.
Figure 7:
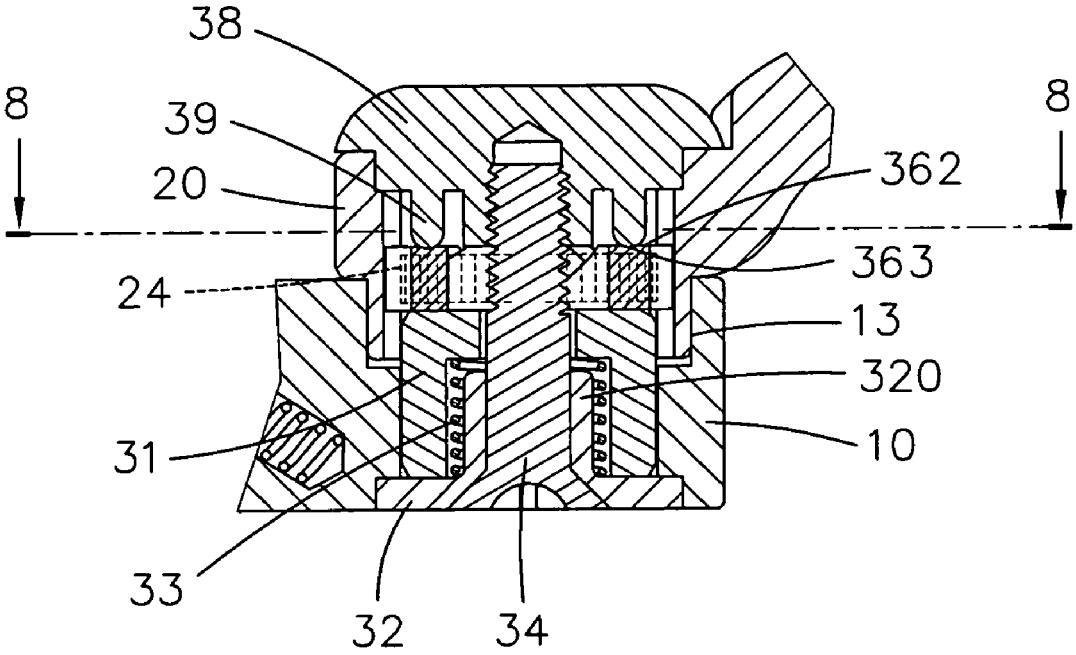
FIG. 7 is a cross-sectional view of the bi-sectional wrench in another position than shown in FIG. 4.

Referring to FIGS. 7 and 8, the switch 38 is rotated to a second position where the tips of the rods 39 are located in the upper holes 361. While a user is pushing the switch 38 to the second position from the first position, the user are moving the tips of the rods 39 on the slopes 36, thus pushing down the pusher 35. Thus, the user is pushing the toothed wheel 31 to the second position from the first position against the force of the elastic element 33. The teeth 310 of the toothed wheel 31 are engaged with only the teeth 14 of the lever 10. Therefore, angular movement between the handle 20 and the lever 10 is allowed.

Figure 9:
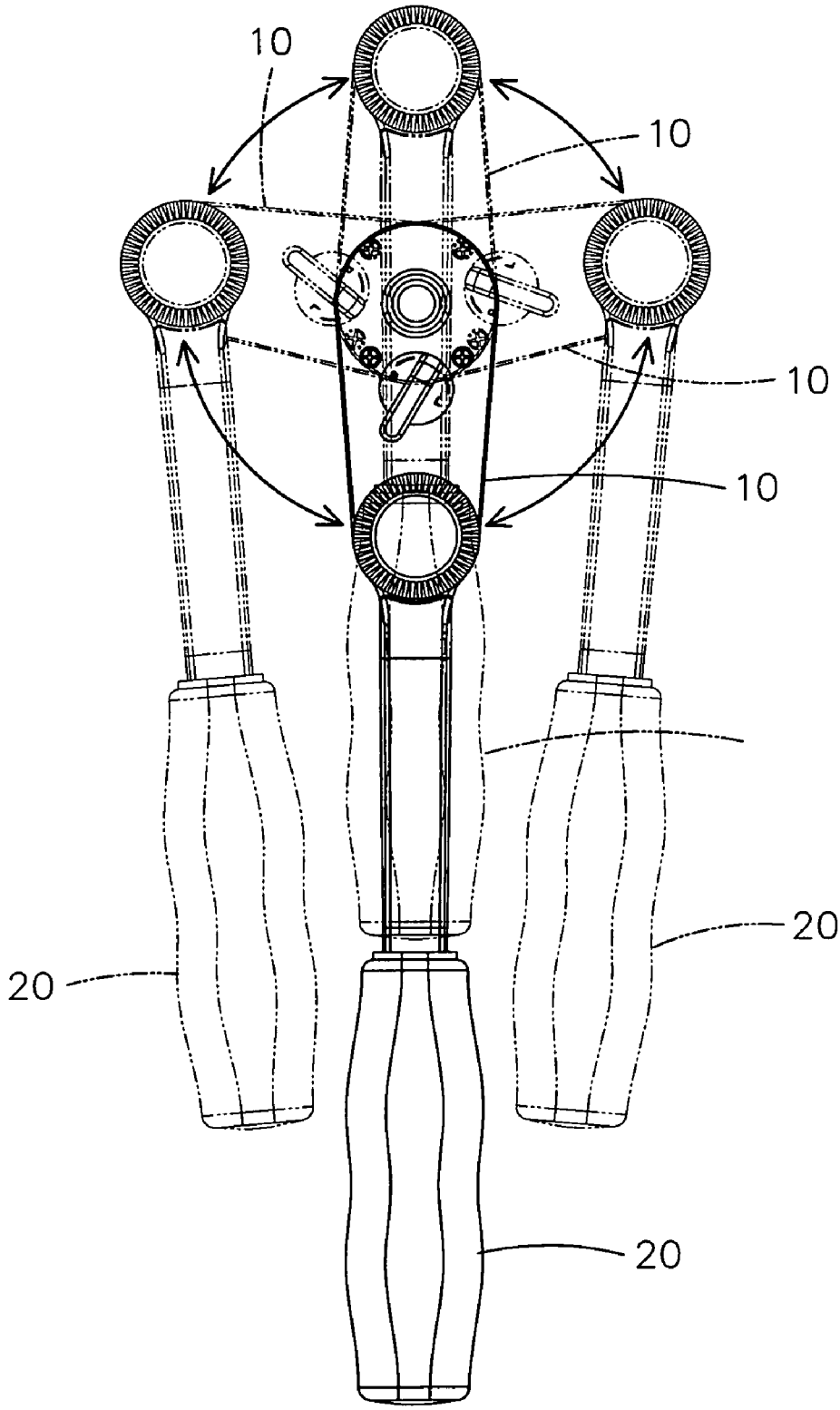
FIG. 9 is a top view of the bi-sectional wrench of FIG. 2, showing the bi-sectional wrench in various positions in use.

Referring to FIG. 9, the bi-sectional wrench is operated in a second manner in which the lever 10 and the handle 20 are rotated by different angular speeds. The second manner is preferred when there is limited room for maneuvering.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A bi-sectional wrench comprising:

a lever comprising a space defined therein and a plurality of teeth formed on the wall of the space;

a handle comprising a space defined therein and a plurality of teeth formed on the wall of the space;

a toothed wheel movable in the spaces between a first position and a second position, wherein the teeth of the toothed wheel are engaged with the teeth of the handle and the teeth of the lever so that the handle and the lever are rotated by a common angular speed in the first position of the toothed wheel, wherein the teeth of the toothed wheel are only engaged with the teeth of one of the handle and the lever so that the handle and the lever are rotated by different angular speed in the second position of the toothed wheel; and a switch operable for moving the toothed wheel between the first and second positions.

2. The bi-sectional wrench according to claim 1 comprising a pusher for pushing the toothed wheel under the control of the switch.

3. The bi-sectional wrench according to claim 2 wherein the pusher is moved but not rotated when the switch is rotated.

4. The bi-sectional wrench according to claim 3 wherein the pusher comprises at least one slope formed on a side, wherein the switch comprises at least one rod formed on a side, wherein the tip of the rod of the switch travels on the slope of the pusher so that the switch pushes the pusher when the switch is rotated relative to the pusher.

5. The bi-sectional wrench according to claim 4 wherein the slope comprises a lower end defining a lower hole for receiving the tip of the rod in the first position of the toothed wheel and an upper end defining an upper hole for receiving the tip of the rod in the second position of the toothed wheel.

6. The bi-sectional wrench according to claim 3 wherein one of the handle and the lever defines a groove in the wall of the space, wherein the pusher comprises at least one slide movable in the groove.

7. The bi-sectional wrench according to claim 2 comprising an elastic element for biasing the toothed wheel to the first position.

8. The bi-sectional wrench according to claim 7 comprising a cover for supporting the elastic element.

9. The bi-sectional wrench according to claim 8 comprising a fastener for fastening the cover to the switch.

10. The bi-sectional wrench according to claim 1 wherein the lever comprising a selective one-way driver for driving a bit in a selected one of two opposite directions.

11. The bi-sectional wrench according to claim 10 wherein the lever comprises a switch operable for switching the selective one-way driver between two modes corresponding to the opposite directions.

* * * * *